US008110020B2

(12) United States Patent
Bergman et al.

(10) Patent No.: US 8,110,020 B2
(45) Date of Patent: Feb. 7, 2012

(54) METALLURGICAL POWDER COMPOSITION AND METHOD OF PRODUCTION

(75) Inventors: Ola Bergman, Helsingborg (SE); Paul Dudfield Nurthen, East Peckman (GB)

(73) Assignee: Höganäs AB (PUBL), Höganäs (SE)

( * ) Notice: Subject to any disclaimer, the term of this patent is extended or adjusted under 35 U.S.C. 154(b) by 130 days.

(21) Appl. No.: 12/679,555

(22) PCT Filed: Sep. 24, 2008

(86) PCT No.: PCT/EP2008/062745

§ 371 (c)(1), (2), (4) Date: Apr. 9, 2010

(87) PCT Pub. No.: WO2009/040369

PCT Pub. Date: Apr. 2, 2009

(65) Prior Publication Data

US 2010/0206129 A1 Aug. 19, 2010

Related U.S. Application Data

(60) Provisional application No. 60/960,525, filed on Oct. 2, 2007.

(30) Foreign Application Priority Data

Sep. 28, 2007 (DK) ..... 2007 01397

(51) Int. Cl.
*B22F 1/00* (2006.01)
*B22F 3/12* (2006.01)

(52) U.S. Cl. ..... 75/255; 75/252; 75/231; 75/243; 75/246; 75/331

(58) Field of Classification Search ..... 75/231, 75/243, 246, 252, 255, 331
See application file for complete search history.

(56) References Cited

U.S. PATENT DOCUMENTS

| | | | | |
|---|---|---|---|---|
| 3,150,444 | A * | 9/1964 | Reen | 419/48 |
| 4,808,226 | A | 2/1989 | Adam | |
| 5,312,475 | A * | 5/1994 | Purnell et al. | 75/246 |
| 5,856,625 | A | 1/1999 | Saunders et al. | |
| 6,365,095 | B1 | 4/2002 | Bergkvist | |
| 6,679,932 | B2 | 1/2004 | Birler et al. | |

FOREIGN PATENT DOCUMENTS

| | | | |
|---|---|---|---|
| WO | WO 98/58093 | A1 | 12/1998 |
| WO | WO 2008/034614 | A1 | 3/2008 |

OTHER PUBLICATIONS

International Search Report of PCT/EP2008/062745 dated Jan. 20, 2009.

Written Opinion of the International Searching Authority of PCT/EP2008/062745 dated Jan. 20, 2009.

* cited by examiner

*Primary Examiner* — Roy King
*Assistant Examiner* — Ngoclan Mai
(74) *Attorney, Agent, or Firm* — Buchanan Ingersoll & Rooney PC

(57) ABSTRACT

An annealed pre-alloyed water atomised iron-based powder suitable for the production of pressed and sintered components having high wear resistance is provided. The iron-based powder comprises 10-below 18% by weight of Cr, 0.5-5% by weight of each of at least one of Mo, W, V and Nb, and 0.5-2%, preferably 0.7-2% and most preferably 1-2% by weight of C. The powder has a matrix comprising less than 10% by weight of Cr, and comprises large $M_{23}C_6$-type carbides in combination with $M_7C_3$-type carbides. A method for production of the iron-based powder, a method for producing a pressed and sintered component having high wear resistance, and a component having high wear resistance are provided.

20 Claims, 1 Drawing Sheet

METALLURGICAL POWDER COMPOSITION AND METHOD OF PRODUCTION

FIELD OF THE INVENTION

The present invention relates to an iron-based powder. Especially the invention concerns a powder suitable for the production of wear-resistant products such as valve seat inserts (VSI) as well as a component made from the powder.

BACKGROUND ART

Products having high wear-resistance are extensively used and there is a constant need for less expensive products having the same or better performance as/than existing products. Only valve seats inserts are produced in an amount of more than 1,000,000,000 components annually.

The manufacture of products having high wear-resistance may be based on e.g. powders, such as iron or iron-based powders, including carbon in the form of carbides.

Carbides are very hard and have high melting points, characteristics which give them a high wear resistance in many applications. This wear resistance often makes carbides desirable as components in steels, e.g. high speed steels (HSS), that require a high wear resistance, such as steels for drills, lathes, valve seat inserts and the likes.

A VSI in a combustion engine is a ring that is inserted where the valve comes in contact with the cylinder head during operation. The VSI is used to limit the wear, caused by the valve, on the cylinder head. This is done by using a material in the VSI that can resist wear better than the cylinder head material, without wearing on the valve. The materials used for VSI are cast materials or more commonly pressed and sintered PM materials.

Producing a valve seat insert with powder metallurgy offers a wide flexibility in composition of the VSI and a very cost effective product. The method of fabricating a PM valve seat insert starts with preparation of a mix which includes all ingredients needed in the final component. The powder mix most commonly includes an iron or low alloyed powder serving as matrix in the final component, elemental alloying elements such as C, Cu, Ni, Co etc which should to a lower or higher extent diffuse into the matrix material and enhance strength and hardness. Further hard phase materials containing carbides and similar phases can be added to increase the wear resistance of the alloy. It is also common to have machinability enhancers added to decrease tool wear when machining the finished product, as well as solid lubricants in order to assist the lubrication during service in the engine. Further, in all press ready mixes evaporative lubricants are added to assist compaction and ejection of the compacted component. A known VSI material, produced by Powder Metallurgy, is based on high speed steel powder as carbide containing matrix material. All powders used normally have a particle size of less than 180 μm. The average particle size of the mix is usually between 50 to 100 μm to allow the mix to flow and facilitate production. The alloying and lubricant additives are in many cases finer in particle size compared to the matrix powder to improve distribution of alloying elements in the powder mix and finished component.

The powder mix is then fed into a tool cavity with the shape of a VSI ring. An axial pressure between 400-900 MPa is applied resulting in a near net shape metallic VSI component having a density between 6.4-7.3 g/cm$^3$. In some instances dual compaction is used to decrease the use of expensive alloying elements. In dual compaction two different powder mixes are used. One more expensive with excellent wear properties creating the wear surface of VSI facing the valve and one less costly to give the desired height of the component. After the compaction the individual grains are only loosely bonded through cold welding, and a subsequent sintering operation is required to allow the individual particles to diffuse together and to distribute alloying elements. Sintering is usually performed at temperatures between 1120° C. and 1150° C. but temperatures up to 1300° C. can be used, in a reducing atmosphere usually based on Nitrogen and Hydrogen. During sintering or after, copper can be infiltrated in the pores of the component to increase hardness and strength as well as improve heat conductivity and wear properties. In many cases subsequent heat treatments are performed to reach final properties. In order to achieve desired geometrical accuracy of the VSI it is machined to desired size. The final machining is in many cases done after VSI is mounted in the cylinder head. The final machining is done in order to give the VSI and inverted valve profile and to have small dimensional variations.

Examples of conventional iron-based powders with high wear resistance are disclosed in e.g. the U.S. Pat. No. 6,679,932, relating to a powder mixture including a tool steel powder with finely dispersed carbides, and the U.S. Pat. No. 5,856,625 relating to a stainless steel powder.

W, V, Mo, Ti and Nb are strong carbide forming elements which make these elements especially interesting for the production of wear resistant products. Cr is another carbide forming element. Most of these conventional carbide forming metals are, however, expensive and result in an inconveniently high priced product. Thus, there is a need within the powder metallurgical industry for a less expensive iron-based powder, or high speed steel, which is sufficiently wear resistant for applications such as for valve seats or the like.

As chromium is a much cheaper and more readily available carbide forming metal than other such metals used in conventional powders and hard phases with high wear resistance, it would be desirable to be able to use chromium as principal carbide forming metal. In that way the powder, and thus the compacted product, can be more inexpensively produced.

The carbides of regular high speed steels are usually quite small, but in accordance with the present invention it has now unexpectedly been shown that powders having equally advantageous wear resistance, for e.g. valve seat applications, may be obtained with chromium as the principal carbide forming metal, provided that a sufficient amount of large carbides exists, supported by a minor amount of finer and harder carbides.

SUMMARY OF THE INVENTION

An objective of the present invention is thus to provide an inexpensive iron-based powder for the manufacture of powder metallurgical products having a high wear resistance.

This objective, as well as other objectives evident from the discussion below, are according to the present invention achieved through an annealed pre-alloyed water atomised iron-based powder, comprising from 10 to below 18% by weight of Cr, 0.5-5% by weight of each of at least one of Mo, W, V and Nb, 0.5-2%, preferably 0.7-2% and most preferably 1-2% by weight of C, wherein the iron-based powder has a matrix comprising less than 10% by weight of Cr. Further, the iron-based powder comprises large chromium carbides and finer and harder chromium carbides.

As high Cr amounts in the powder promote formation of large type carbides e.g. of the type $M_{23}C_6$-, then 18% by weight and above of Cr will give a too low content of fine and hard chromium carbides.

In accordance with the present invention this new powder which achieves the above objectives may be obtained through a method of producing an iron-based powder comprising subjecting an iron-based melt including 10-below 18% by weight of Cr, 0.5-5% by weight of each of at least one of Mo, W, V and Nb and 0.5-2%, preferably 0.7-2% and most preferably 1-2% by weight of C to water atomisation in order to obtain iron-based powder particles, and annealing the powder particles at a temperature, and for a period of time, sufficient for obtaining the desired carbides within the particles.

In preferred embodiments, it has been found that temperatures in the range of 900-1100° C. and annealing times in the range of 15-72 hours are sufficient for obtaining the desired carbides within the particles.

DETAILED DESCRIPTION OF PREFERRED EMBODIMENTS

Figure 1:
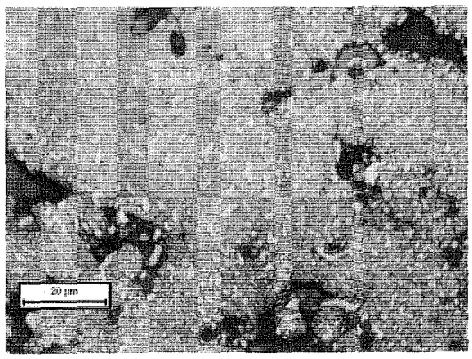
FIG. 1 shows the microstructure of OB1 based test material.

The pre-alloyed powder of the invention contains chromium, 10-below 18% by weight, at least one of molybdenum, tungsten, vanadium and niobium, 0.5-5% by weight of each, and carbon, 0.5-2%, preferably 0.7-2% and most preferably 1-2% by weight, the balance being iron, optional other alloying elements and inevitable impurities.

The pre-alloyed powder may optionally include other alloying elements, such as silicon, up to 2% by weight. Other alloying elements or additives may also optionally be included.

It should specifically be noted that the very expensive carbide forming metals niobium and titanium are not needed in the powder of the present invention.

The pre-alloyed powder preferably has an average particle size in the range of 40-100 μm, preferably of about 80 μm.

In preferred embodiments the pre-alloyed powder comprises 12-17% by weight of Cr, such as 15-17% by weight of Cr, e.g. 16% by weight of Cr.

In preferred embodiments the pre-alloyed powder comprises 12-below 18% by weight of Cr, 1-3 wt % of Mo, 1-3.5 wt % of W, 0.5-1.5 wt % of V, 0.2-1 wt % of Si, 1-2 wt % of C and balance Fe.

In most preferred embodiments the pre-alloyed powder comprises 14-below 18 weight of Cr, 1-2 wt % of Mo, 1-2 wt % of W, 0.5-1.5 wt % of V, 0.2-1 wt % of Si, 1-2 wt % of C and balance Fe.

In another most preferred embodiment the pre-alloyed powder comprises 12-below 15 weight of Cr, 1-2 wt % of Mo, 2-3 wt % of W, 0.5-1.5 wt % of V, 0.2-1 wt % of Si, 1-2 wt % of C and balance Fe.

In preferred embodiments, the large chromium carbides are of $M_{23}C_6$-type, (M=Cr, Fe, Mo, W,), i.e. besides Cr as the dominating carbide forming element one or more of Fe, Mo and W may be present.

In preferred embodiments, the finer and harder chromium carbides are of $M_7C_3$-type (M=Cr, Fe, V), i.e. besides chromium as the dominating carbide forming element one or more of Fe and V may be present. Both types of carbides may also contain other than the above specified carbide forming elements in small amounts. The powder may further comprise other than the above carbide types.

The large carbides of the inventive powder preferably have an average size in the range of 8-45 μm, more preferably in the range of 8-30 μm, a hardness of about 1100-1300 microvickers and preferably make up 10-30% by volume of the total powder.

The $M_7C_3$-type smaller carbides of the inventive powder are smaller and harder than the $M_{23}C_6$-type large carbides. The smaller carbides of the inventive powder preferably have an average size below 8 μm, a hardness of about 1400-1600 microvickers and preferably make up 3-10% by volume of the total powder.

As the carbides have an irregular shape, "size" defines the longest extension as measured in a microscope.

In order to obtain these large carbides, the pre-alloyed powder is subjected to prolonged annealing, preferably under vacuum. The annealing is preferably performed in the range of 900-1100° C., most preferably at about 1000° C., at which temperature chromium of the pre-alloyed powder reacts with carbon to form chromium carbides.

During the annealing, new carbides are formed and grow and existing carbides continue to grow through reaction between chromium and carbon. The annealing is preferably continued for 15-72 hours, more preferably for more than 48 hours, in order to obtain carbides of desired size. The longer the duration of the annealing, the larger the carbide grains grow. However, the annealing consumes lots of energy and might be a production flow bottle neck if it continues for a long time. Thus, although an average chromium carbide grain size of the large chromium carbides of about 20-30 μm may be optimal, it might, depending on priority, be more convenient from an economic point of view to terminate the annealing earlier, when the average chromium carbide grain size of the large chromium carbides is about 10 μm.

Very slow cooling, preferably more than 12 hours, from annealing temperature is applied. Slow cooling will allow further growth of carbides, as a larger amount of carbides is thermodynamically stable at lower temperatures. Slow cooling will also assure that the matrix becomes ferritic, which is important for the compressibility of the powder.

Annealing the powder also has other advantages besides the growth of carbides.

During annealing also the matrix grains grow and the inherent stresses of the powder particles, obtained as a result of the water atomisation, are relaxed. These factors make the powder less hard and easier to compact, e.g. gives the powder higher compressibility.

During annealing, the carbon and oxygen contents of the powder may be adjusted. It is usually desirable to keep the oxygen content low.

During annealing carbon is reacted with oxygen to form gaseous carbon oxide, which reduces the oxygen content of the powder. If there is not enough carbon in the pre-alloyed powder itself, for both forming carbides and reducing the oxygen content, additional carbon, in form of graphite powder, may be provided for the annealing.

As much of the chromium of the pre-alloyed powder migrates from the matrix to the carbides during annealing, the matrix of the resulting annealed powder has a content of dissolved chromium of less than 10% by weight of the matrix, preferably less than 9% by weight and most preferably less than 8% by weight, why the powder is not stainless.

The matrix composition of the powder is designed such that ferrite transforms to austenite during sintering. Thereby, the austenite can transform into martensite upon cooling after sintering. Large carbides in combination with smaller and harder carbides in a martensitic matrix will give good wear resistance of the pressed and sintered component.

The annealed powder of the invention may be mixed with other powder components, such as other iron-based powders, graphite, evaporative lubricants, solid lubricants, machinability enhancing agents etc, before compaction and sintering to produce a product with high wear resistance. One may e.g. mix the inventive powder with pure iron powder and graphite powder, or with a stainless steel powder. A lubricant, such as a wax, stearate, metal soap or the like, which facilitates the compaction and then evaporates during sintering, may be added, as well as a solid lubricant, such as MnS, $CaF_2$, $MoS_2$, which reduces friction during use of the sintered product and which also may enhance the machinability of the same. Also other machinability enhancing agents may be added, as well as other conventional additives of the powder metallurgical field.

Due to its good compressibility the obtained mix is well suited for compacting into near net shape VSI components having a chamfered inverted valve profile.

Example 1

A melt of 16.0 wt % Cr, 1.5 wt % Mo, 1.5 wt % W, 1 wt % V, 0.5 wt % Si, 1.5 wt % C and balance Fe was water atomised to form a pre-alloyed powder. The obtained powder was subsequently vacuum annealed at 1000° C. for about 48 hours, the total annealing time being about 60 hours, after which the powder particles contained about 20% by volume of $M_{23}C_6$-type carbides of an average grain size of about 10 μm and about 5% by volume of $M_7C_3$-type carbides of an average grain size of about 3 μm in a ferritic matrix.

The obtained powder (hereafter referred to as OB1) was mixed with 0.5 wt % graphite and 0.75 wt % of an evaporative lubricant. The mix was compacted into test bars at a pressure of 700 MPa. The obtained samples were sintered in an atmosphere of $90N_2/10H_2$ at a temperature of 1120° C. After sintering the samples were subjected to cryogenic cooling in liquid nitrogen followed by tempering at 550° C.

A similar mix based on the known HSS powder M3/2, was prepared and test bars were produced using the same process as the one described above.

The test bars were subjected to hardness tests according to the Vickers method. Hot hardness was tested at three different temperatures (300/400/500° C.). The results are summarised in the table below.

| Powder | Porosity | | | Hot hardness (HV5) | | |
|---|---|---|---|---|---|---|
| in mix | (%) | HV0.025 | HV5 | 300° C. | 400° C. | 500° C. |
| OB1 | 21 | 925 | 382 | 317 | 299 | 249 |
| M3/2 | 17 | 836 | 415 | 363 | 326 | 267 |

The microstructure of the OB1 test material (see FIG. 1) consists of the desired mixture of large and small carbides in a martensitic matrix. The reference material has similar microstructure (see FIG. 2) but with smaller carbides than the OB1 material.

The OB1 material has somewhat higher porosity than the M3/2 material, which explains why the OB1 hardness values (HV5) are lower than those for M3/2 although the OB1 microhardness is higher than that for M3/2. In the production of PM VSI components, the porosity is normally eliminated by copper infiltration during sintering and such effects can therefore be neglected. In the light of this, the hardness values of the OB1 material are comparable to those of the reference M3/2 material, which gives good indication that the materials should have comparable wear resistance. Especially, maintaining hardness at elevated temperatures is important for wear resistance in VSI applications. The hot hardness test results show that the OB1 material meets these requirements.

Example 2

A melt of 14.5 wt % Cr, 1.5 wt % Mo, 2.5 wt % W, 1 wt % V, 0.5 wt % Si, 1.5 wt % C and balance Fe was water atomised to form a pre-alloyed powder. The obtained powder was subsequently vacuum annealed at 1000° C. for about 48 hours, the total annealing time being about 60 hours, after which the powder particles contained about 20% by volume of $M_{23}C_6$-type carbides of an average grain size of about 10 μm and about 5% by volume of $M_7C_3$-type carbides of an average grain size of about 3 μm in a ferritic matrix.

Figure 2:
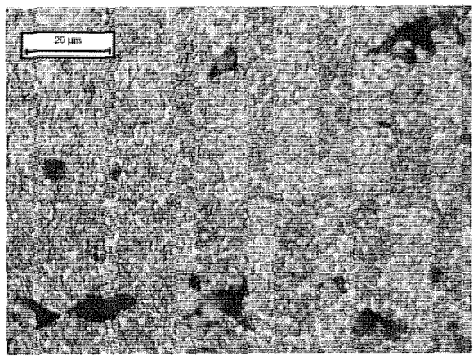
FIG. 2 shows the microstructure of M3/2 based test material.

Processing this powder, mixed with 0.5 wt % graphite and 0.75 wt % of an evaporative lubricant, to produce test bars in the same way as in example 1, resulted in a microstructure very similar to that in FIG. 1.

The invention claimed is:

1. An annealed pre-alloyed water atomised iron-based powder, comprising:

10-below 18% by weight of Cr;

0.5-5% by weight of each of at least one of Mo, W, V and Nb; and 0.5-2% by weight of C;

wherein the iron-based powder has a matrix comprising less than 10% by weight of Cr, and wherein the iron-based powder comprises large chromium carbides and smaller and harder chromium carbides.

2. An iron-based powder according to claim 1 , including large chromium carbides having an average size of 8-45 μm and smaller and harder chromium carbides having an average size less than 8 μm.

3. An iron-based powder according to claim 1 , including large chromium carbides having an average size of 8-30 μm and smaller and harder chromium carbides having an average size less than 8 μm.

4. An iron-based powder according to claim 1, comprising 10-30% by volume of large chromium carbides and 3-10% by volume of smaller and harder chromium carbides.

5. An iron-based powder according to claim 1, wherein the matrix is not stainless.

6. An iron-based powder according to claim 1, wherein the powder further comprises 0-2% by weight Si.

7. An iron-based powder according to claim 1, having a weight average particle size of 40-100 μm.

8. An iron-based powder according to claim 1, comprising of 12-below 18% by weight of Cr, 1-3 wt % of Mo, 1-3.5 wt % of W, 0.5-1.5 wt % of V, 0.2-1 wt % of Si, 1-2 wt % of C, and balance Fe.

9. An iron-based powder according to claim 1, comprising 12-below 15% by weight of Cr, 1-2 wt % of Mo, 2-3 wt % of W, 0.5-1.5 wt % of V, 0.2-1 wt % of Si, 1-2 wt % of C, and balance Fe.

10. An iron-based powder according to claim 1, comprising 14-below 18 weight of Cr, 1-2 wt% of Mo, 1-2 wt % of W, 0.5-1.5 wt% of V, 0.2-1 wt% of Si, 1-2 wt% of C, and balance Fe.

11. An iron-based powder according to claim 1 , wherein the large chromium carbides are of $M_{23}C_6$-type where M=Cr, Fe, Mo, W.

12. An iron-based powder according to claim 1 , wherein the smaller and harder chromium carbides are of $M_7C_3$-type where M=Cr, Fe, V.

13. A method of producing an iron-based powder comprising a matrix having less than 10% by weight of Cr comprising: subjecting an iron-based melt including 10-below 18% by weight of Cr, 0.5-5% by weight of each of at least one of Mo, W, V and Nb, and 0.5-2% by weight of C to water atomisation in order to obtain iron-based powder particles; and annealing the powder particles at a temperature, and for a period of time, sufficient for obtaining large chromium carbides and smaller and harder chromium carbides within the particles.

14. A pressed and sintered component produced from at least a powder according to claim 1.

15. A pressed and sintered component according to claim 14;

wherein a part of the C-content is alloyed during sintering.

16. A pressed and sintered component according to claim 14;

wherein the pressed and sintered component is produced from a powder composition comprising the powder according to claim 1 and at least one of an iron-based powder, graphite, an evaporative lubricant, a solid lubricant, or a machinability enhancing agent.

17. A pressed and sintered component according to claim 14, wherein the pressed and sintered component is a valve seat insert.

18. A pressed and sintered component according to claim 17, comprising a chamfered mating surface having an inverted valve profile formed during compaction.

19. An annealed pre-alloyed water atomised iron-based powder according to claim 1, wherein C is present in a concentration of 1-2% by weight.

20. A method for producing an iron-based powder according to claim 13, wherein the iron-based melt that is subjected to water atomisation comprises 1-2% by weight C.

* * * * *